US005655893A

United States Patent [19]

Kubo

[11] Patent Number: 5,655,893

[45] Date of Patent: Aug. 12, 1997

[54] BELLOWS PUMP

[75] Inventor: Hiroshi Kubo, Chiryu, Japan

[73] Assignee: Aisin Seiki Kabushiki Kaisha, Kariya, Japan

[21] Appl. No.: 577,522

[22] Filed: Dec. 22, 1995

[30] Foreign Application Priority Data

Dec. 26, 1994 [JP] Japan ..... 6-337951
Nov. 22, 1995 [JP] Japan ..... 7-328199

[51] Int. Cl.[6] ..... F04B 43/06

[52] U.S. Cl. ..... 417/386; 417/472

[58] Field of Search ..... 417/385, 386, 417/387, 472, 490, 499

[56] References Cited

U.S. PATENT DOCUMENTS

| | | | |
|---|---|---|---|
| 2,343,962 | 3/1944 | Dodson | 417/387 |
| 2,843,045 | 7/1958 | Mashinter | 417/386 X |
| 3,507,583 | 4/1970 | James | 417/385 X |
| 4,865,525 | 9/1989 | Fritsch et al. | 417/385 X |
| 5,221,196 | 6/1993 | Harbig et al. | 417/499 |
| 5,520,523 | 5/1996 | Yorita et al. | 417/387 |

FOREIGN PATENT DOCUMENTS

| | | | |
|---|---|---|---|
| 528191 | 5/1954 | Belgium | 417/386 |
| 4-321781 | 11/1992 | Japan . | |
| 345800 | 5/1960 | Switzerland | 417/386 |
| 193222 | 4/1967 | U.S.S.R. | 417/387 |

*Primary Examiner*—Richard E. Gluck
*Attorney, Agent, or Firm*—Burns, Doane, Swecker & Mathis, LLP

[57] ABSTRACT

A bellows pump exhibiting stable and highly efficient performance. The bellows pump is composed of a first work chamber for admitting fluid, a second work chamber for storing work fluid, a bellows for parting a chamber space into the first and the second work chambers; a plunger being movable in a reciprocative manner to and form the second work chamber; a work fluid chamber which is opened; and a drive member for the plunger.

The plunger is provided with a flow channel with a second communication port communicating only at the initial and completing stage of an inflow process of the fluid. A first communication port locates in the vicinity of a top of the first work chamber. The second communication port locates above the first communication port.

6 Claims, 5 Drawing Sheets

BELLOWS PUMP

BACKGROUND OF THE INVENTION

1. Field of the Invention

This invention relates to a bellows pump used as a pressurized pump for pumping fluid such as gasoline.

2. Prior Art

A publication of Laid Open Japanese Patent Application No. 321781 (1992) has disclosed a bellows pump 9 as shown in FIG. 5. The bellows pump 9 is composed of a first work chamber 91 for admitting fluid, a second work chamber 92 for storing work fluid, a bellows 93 for parting a cheer space into the first work cheer 91 and the second work chamber 92, a piston 94 which moves in a reciprocative manner up to or down from the second work cheer 92 and a work fluid cheer 95. The bellows pump 9 has an oil passage 96 formed therein through which the second work chamber 92 communicates with the work fluid chamber 95 in the vicinity of a bottom dead center of the piston 94.

Referring to FIG. 5, reference numerals 971 and 972 designate a drive shaft and an eccentric cam, respectively for driving the piston 94 up and down. Reference numerals 981 and 982 designate check valves mounted at an inlet port and an outlet port, respectively for limiting the fluid flow to one direction.

The bellows 93 contracts and expands accompanied with the reciprocative motion of the piston 94, by which the fluid is pumped from an inflow channel 985 to an outflow channel 986 under pressure. With this conventional bellows pump 9 if the cycle count of the piston 94 is kept constant, the flow rate "Q" of the fluid becomes constant.

However several problems are associated with the aforementioned bellows pump 9. Bubbles generally intrude into the work fluid either spontaneously or curing assembly of the pump, and these bubbles remain in the second work chamber 92. The bellows pump 9 has a structural difficulty in releasing those bubbles out of the second work chamber 92, thus hindering the pump from performing appropriately or even increasing liabilities of damaging the pump.

Assuming that the bellows pump 9 is used as a fuel pump for an automobile, since the flow rate Q of the fluid is defined by the cycle count of the piston irrespective of the engine load, the outflow rate of the fuel will be excessive at a low engine load, resulting in further degradation of the pump performance. Therefore it is highly required to keep a bellows long-lived for a prolonged service life of the bellows pump. It is also necessary to reduce the bellows pump size for increasing the flow rate.

SUMMARY OF THE INVENTION

It is an object of the present invention to provide a bellows pump exhibiting stable and highly efficient performance irrespective of bubbles remained in the work fluid.

The present invention is formed as a bellows pump for pumping fluid by operating a bellows. The bellows pump is provided with a first work chamber for admitting the fluid, a second work chamber for storing work fluid, a bellows being capable of expansion and contraction disposed between the first work chamber and the second work chamber, a plunger being movable in a reciprocative manner to and from the second work chamber, a work fluid chamber opened to store the work fluid and a drive member for driving the plunger. The plunger is provided with a flow channel, one end of which constantly communicates with the second work chamber, and the other end of the flow channel is provided with a second communication port which communicates with the work fluid chamber only when the plunger retracts at the initial and completing stages for an inflow process of the fluid.

When at least the second communication port communicates with the work fluid chamber, a first communication port communicating with the second work chamber locates in the vicinity of a top of the second communication chamber, and the second communication port locates above the first communication port.

BRIEF DESCRIPTION OF THE DRAWINGS

This and other objects, features and advantages of the present invention will become more apparent upon a reading of the following detailed description and drawings, in which.

DETAILED DESCRIPTION OF THE INVENTION

Figure 1:
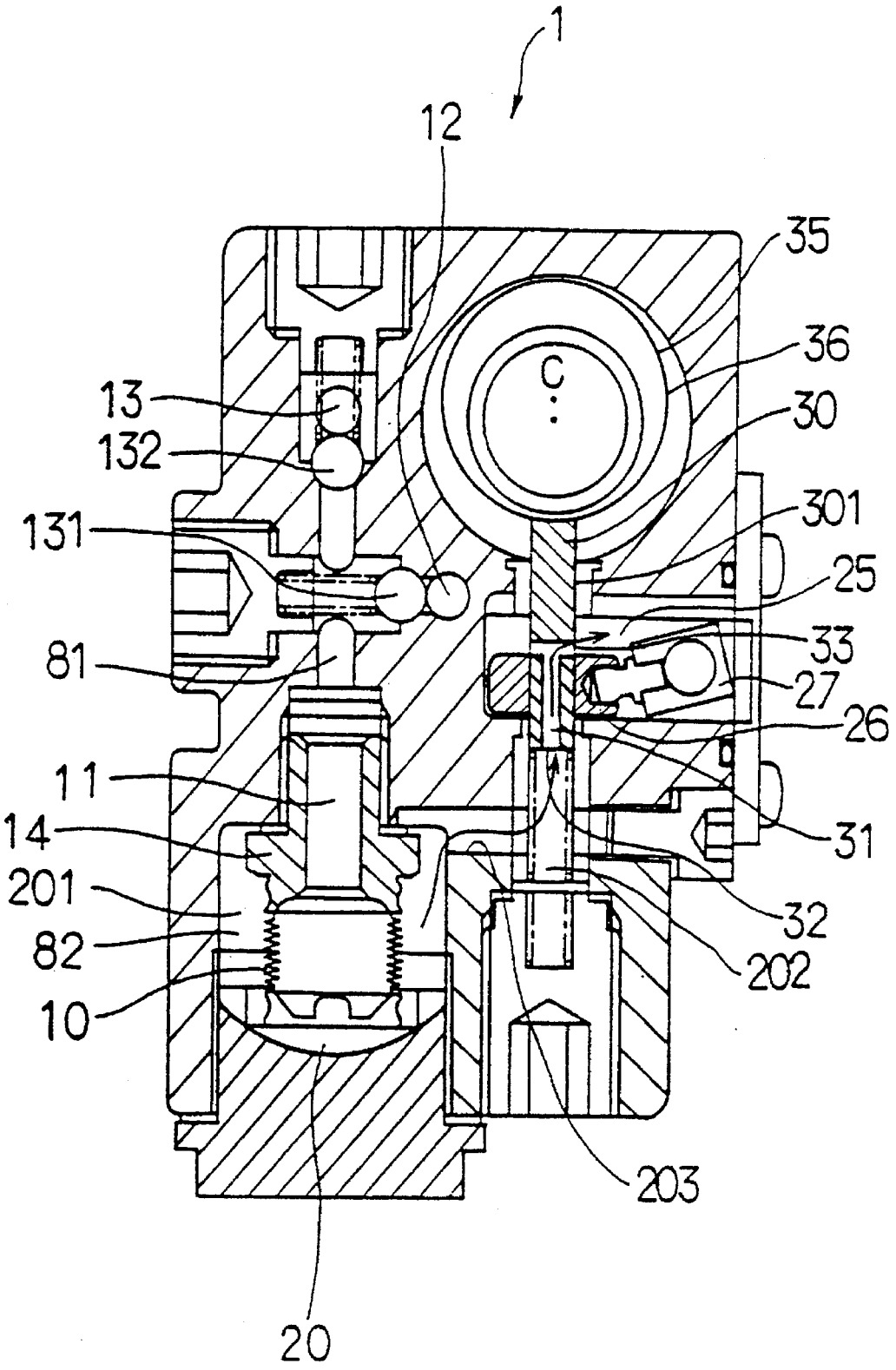
FIG. 1 is a longitudinal sectional view of a bellows pump according to Embodiment 1 (at a top dead center of a plunger)

The most important feature of the present invention is that the plunger of the bellows pump is provided with a flow channel having first and second communication ports formed at its respective ends. In case at least the second communication port communicates with the work fluid chamber, the first communication port is located in the vicinity of a top of the second work chamber. The Second communication port is located above the first communication port.

If the plunger of the bellows pump of the present invention has not retracted to a predetermined position yet, the second communication port is shut off from the work fluid chamber and the second work chamber is closed. Accordingly the pressure within the second work chamber varies according to the plunger motion, thus varying the capacity of the bellows.

during the capacity variation of the bellows, the fluid contained in the first work chamber is pumped in or pumped out.

If the plunger has retracted to the predetermined position and the second communication port communicates with the work fluid chamber, the pressure within the second work chamber becomes approximately the same as that of the work fluid chamber. Then the bellows stops its motion to prevent the fluid from outflowing.

As a result, the flow rate Q of the fluid supplied from the pump becomes proportional to the variation in capacity (a) of the bellows at every stroke of the plunger and stroke count (f) of the plunger at a unit of time, i.e. $Q=(a)\times(f)$.

With the bellows pump of the present invention, if the second communication port communicates with the work fluid chamber, the first communication port is located in the vicinity of the top of the second work chamber, and the second communication port is located above the first communication port.

Even if bubbles remain in the second work chamber, lighter bubbles are forced into a flow channel of the plunger from the first communication port one after another and further forced into the work fluid chamber from the second communication port through the flow channel.

As aforementioned, the bubble intruding into the second chamber no longer remains therein, thus preventing deterioration in performance and efficiency of the pump.

The present invention provides a bellows pump that exhibits stable and highly efficient performance irrespective of intrusion of bubbles into the work fluid.

In case the plunger retracts at either initial or completing stage of an inflow process of the fluid, the second communication port communicates with the work fluid chamber with the aid of devices described below. For example, the second communication port may be formed in the outer peripheral surface of the plunger. A plunger contact member is mounted in the work fluid chamber in contact with the outer peripheral surface of the plunger. The plunger contact member serves to open and close the second communication port accompanied with the plunger motion. The second communication port is so located that the plunger retracts at either initial or completing stage of the inflow process of the fluid by adjusting the position of the plunger contact member.

The plunger contact member may be formed to accurately cover a part of the outer peripheral surface of the plunger. Alternatively it may be formed as an annular member covering the whole outer peripheral surface of the plunger.

Preferably the above bellows pump is provided with a communication positioning means for moving the plunger contact member so as to change the position of the second communication port. When the second communication port communicates with the work fluid chamber, the bellows serves to stop increasing its capacity.

As a result, capacity variation of the bellows at every cycle of the plunger is defined by the relative location of the second communication port communicating with the work fluid chamber.

Adjusting the communicating location of the second communication port may define outflow amount of the fluid per one cycle and the flow rate Q of the bellows pump, thus enabling the pump to function efficiently.

In case the above-described bellows pump is used as a fuel pump of an engine, the communication positioning means is made adjustable dependent on the engine load so as to pump the appropriate amount of the fuel suitable for the load. As a result, the pump is protected from any damage.

At a low engine load, the flow rate Q of the fluid may be decreased by adjusting the above communication positioning means, avoiding excessive fuel supply as well as improving the pump efficiency.

The present invention is so designed that the second work chamber is provided with a main room for housing the bellows and a sub room for housing the plunger. Disposed between the main room and the sub room is preferably an upper passage in substantially a horizontal or ascending direction spanning from the main room to the sub room for communicating the top part of the main room with the sub room. It is also preferable to dispose a lower passage for communicating the bottom part of the main room below the bellows with the sub room.

The above upper passage serves to cause bubbles to flow into the work fluid chamber. The lower passage further presents the effects described below.

When the plunger protrudes toward the sub room, the sub room pressure rises and at the same time the pressure caused by the work fluid flowing into the main room through the lower passage serves to press the bellows to contract. That is, the bellows is contracted not only by the dynamic pressure difference between inside and outside of the bellows but also by the dynamic pressure due to the work fluid flowing into the main room. The bellows operation, thus, can be kept from being delayed.

When operating the bellows by using the pressure difference between inside and outside of the bellows, a small degree of operational delay is irresistible because of inertia in contracted part of the bellows. Such delay increases the pressure difference accompanied With the bellows operation at increased speed, resulting in decreased endurance of the bellows. The present invention, thus, aids in prolonging the service life of the bellows by restraining the operational delay of the bellows. Restraining the operational delay of the bellows may improve drive efficiency of the plunger.

It is also preferable to provide a bypass between the second work chamber and the work fluid chamber. The bypass which is normally closed is provided with a check valve which is designed to open when the second work chamber pressure becomes lower than that of the work fluid chamber.

Supposing that the bypass is not provided, if the second work chamber pressure becomes lower than that of the work fluid chamber, the bubble may flow backward to the second work chamber from the work fluid chamber when the second communication port opens.

Supposing that the bypass is provided, even when the second work chamber pressure becomes lower than that of the work fluid chamber, the check valve of the bypass may serve to release the second work chamber from negative pressure.

More specifically, when the ascending plunger releases the bellows for expansion to open the second communication port, the operational delay of the bellows may decrease the pressure of the second work chamber, resulting in negative pressure. The above-provided bypass opens to supply work fluid contained in the work fluid chamber to the second work chamber.

Figure 3:
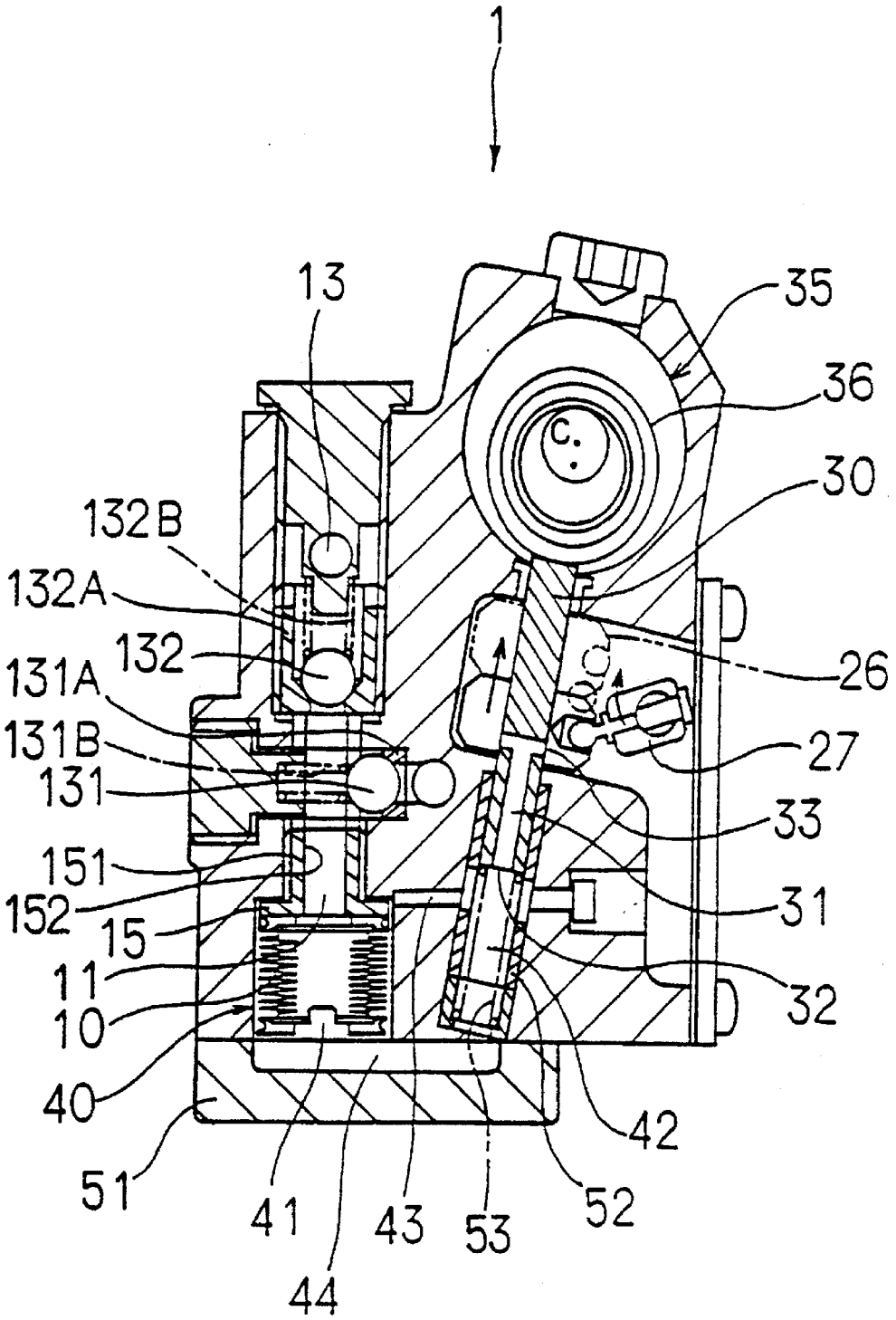
FIG. 3 is a longitudinal sectional view of a bellows pump according to Embodiment 2.
Figure 4:
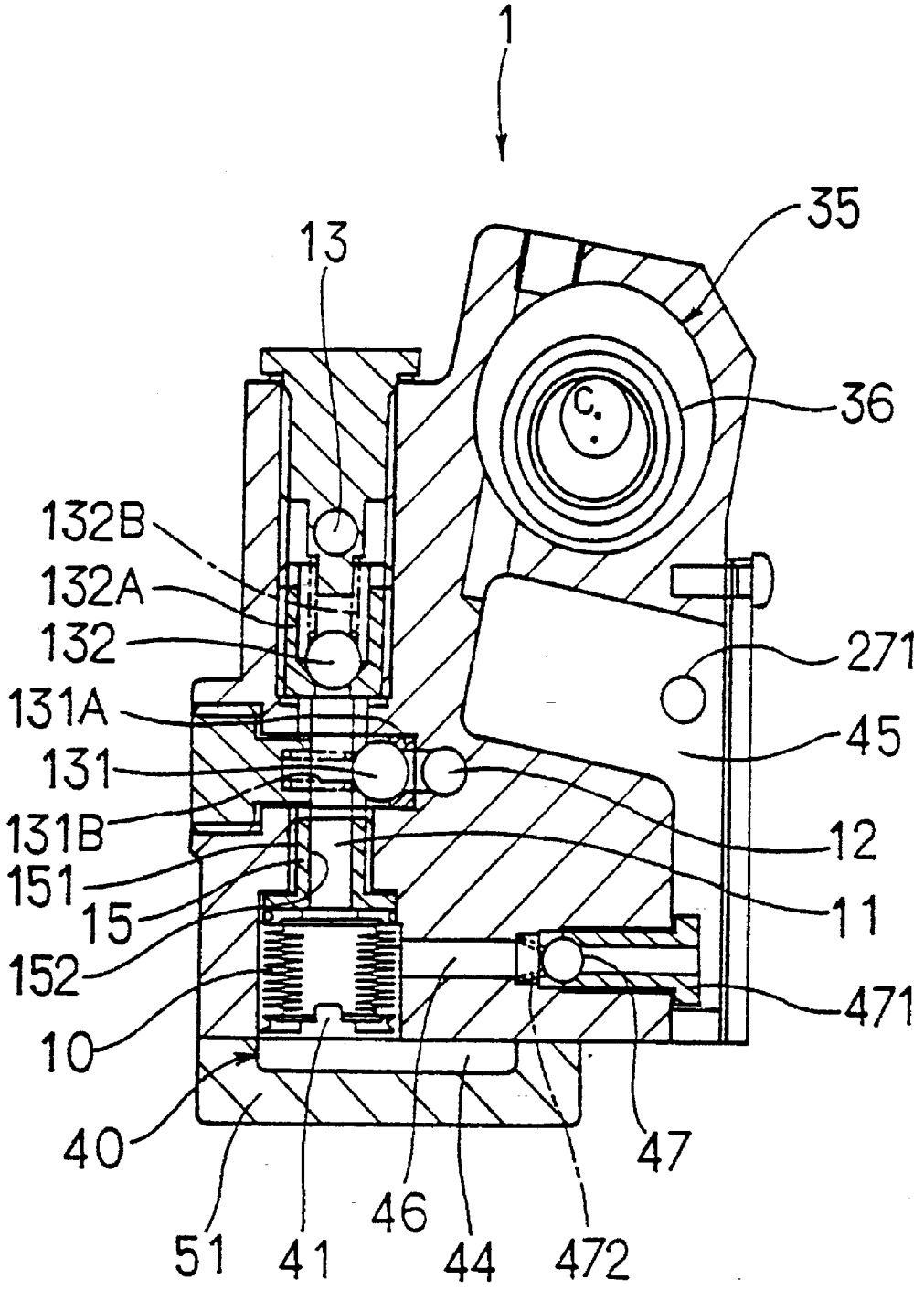
FIG. 4 is a longitudinal sectional view of the bellows pump according to Embodiment 2 when viewed with the broken-out section of FIG. 3 moved in a direction of an axial center C of an eccentric cam.
Figure 5:
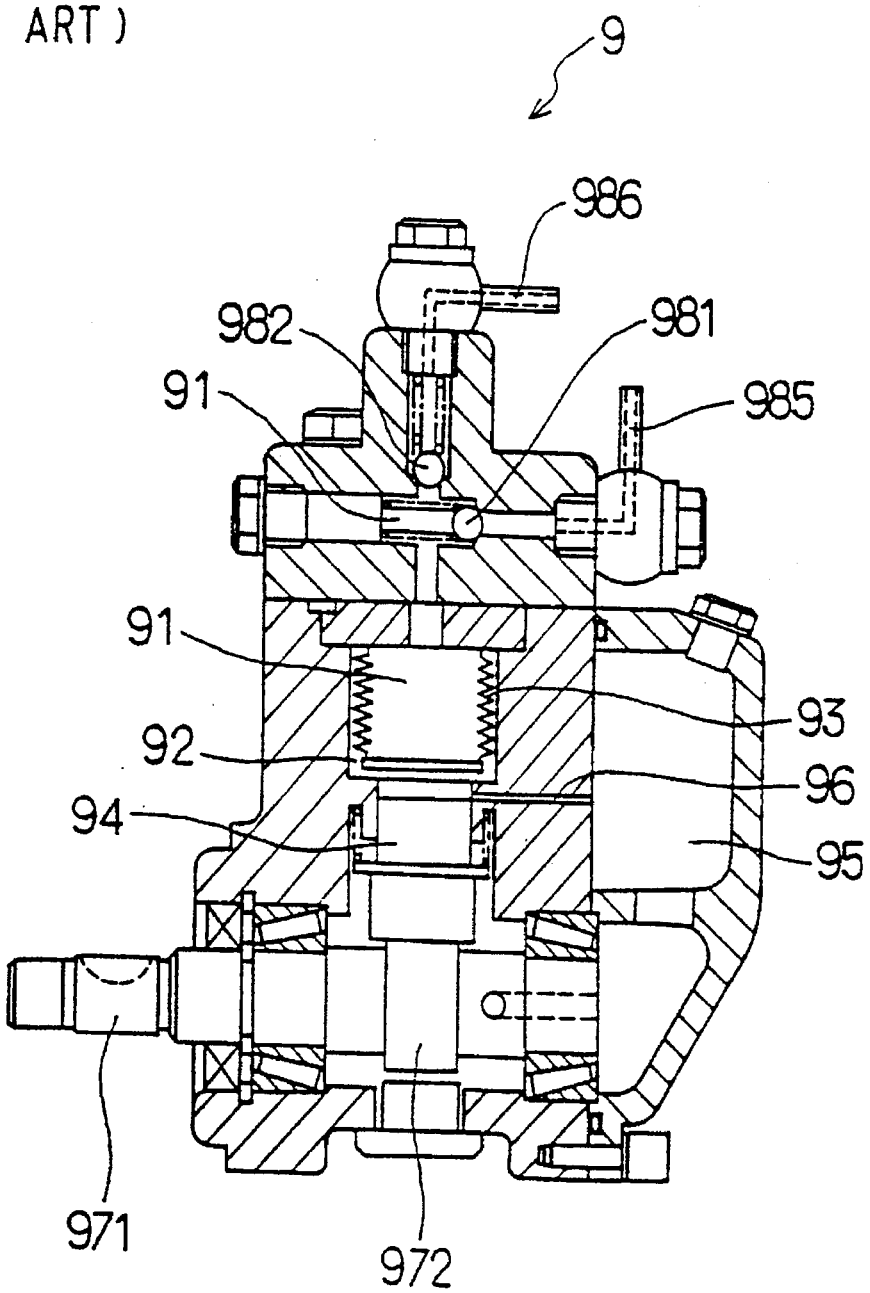
FIG. 5 (PRIOR ART)
FIG. 5 is a longitudinal sectional view of a conventional bellows pump.

In case the bellows is brazed to the first or the second work chamber, it is preferable to form a bore in a fixed member so that the end of a rotating tool used for brazing is fitted (See Embodiment 2, reference numeral 152 in FIGS. 3 and 4).

In order to braze the fixed member to the other member with the tool, it is preferable to rotate by fitting the tool into the bore formed in the fixed member, instead of rotating by holding the fixed member in place from outside, i.e., general screwing.

The aforementioned construction requires no space for admitting the tool between the outer periphery of the fixed member and an inner wall of the second work chamber for housing the bellows, resulting in minimizing the space for the second work chamber. The less the capacity of the work chamber is decreased, the less the compression rate of the work fluid under pressure (loss of exhaust flow rate) becomes, leading to increased flow rate of the bellows pump. For example, supposing that the work fluid is gasoline, the capacity compressive rate results in about 1%/10 MPa. Eliminating unnecessary space may increase outflow rate by a compressed flow rate proportional to the eliminated space.

EMBODIMENT 1

This embodiment is in the form of a bellows pump 1 suitable for use as a fuel pump for an automobile in which a bellows 10 is operated in a reciprocative manner to supply fluid 81.

The bellows pump 1 is composed of a first work chamber 11 for admitting the fluid 81, a second work chamber 20 for storing work fluid 82, the bellows 10 capable of expansion and contraction which parts a chamber space into the first work chamber 11 and the second work chamber 20, a plunger 30 movable toward or away from the second work chamber 20, a work fluid chamber 25 opened for admitting the work fluid 82 and a drive member 35 for driving the plunger 30.

The plunger 30 is provided with a flow channel 31, one end of which constantly communicates with the second work chamber 20. The other end of the flow channel 31 is provided with a second communication port 33 which communicates with the work fluid chamber 25 only when the plunger 30 retracts at the initial and completing stages of the inflow process of the fluid 81.

As shown in FIG. 1, if the second communication port 33 communicates with the work fluid chamber 25, the first communication port 32 constantly communicating with the second work chamber 20 reaches the position in the vicinity of a top of the second work chamber 20. The second communication port 33 is located above the first communication port 32.

The second communication port 33 is formed in an outer peripheral surface 301 of the plunger 30. The work fluid chamber 25 is provided with a plunger contact member 26 which is in contact with the outer periphery 301 of the plunger 30 for closing (FIG. 2) or opening (FIG. 1) the second communication port 33 during reciprocating motion of the plunger 30, and a communication positioning means 27 for changing the communication position of the second communication port 33 by moving the plunger contact member 26.

The plunger contact member 26 is formed as an annular member engaged with the outer periphery of the plunger 30. The communication positioning means 27 is in the form of a drive member for moving the annular member in the axial direction of the plunger 30. The respective members are hereinafter described.

The first work cheer 11 is provided with an inlet port 12 and an outlet port 13 for flowing in and out the fluid 81, respectively. These ports 12 and 13 are provided with check valves 131 and 132, respectively for limiting the fluid 81 to flow in only one direction. The first work cheer 11 contains the bellows 10 on its bottom by fixing a top part thereof to a fixed member 14.

The second work chamber 20 is provided below the first work chamber 11, which is composed of a main room 201 in contact with the bellows 10 and a sub room 202 in contact with the plunger 30.

The lower end surface of the plunger 30 is in contact with the sub room 202. The upper end surface of the plunger 30 is in contact with an eccentric cam 36 forming the drive member 35. The plunger 30 moves up and down through the work fluid chamber 25.

The eccentric cam 3 rotates synchronized with the crank shaft of an engine about an axial center C.

The work fluid chamber 25 is provided with the plunger contact member 26 engaged with the plunger 30, which is movable through the communication positioning means 27 driven by an actuator such as a stepping motor, so that the outflow amount of the bellows pump is adjusted.

The plunger 30 has a flow channel 31 communicating with the upper surface of the sub room 202 via the first communication port 32 at the lower end. The second communication port 33 at an upper end of the flow channel 31 is closed (FIG. 2) or opened (FIG. 1) with an inner wall surface of the plunger contact member 26 accompanied with the reciprocative motion of the plunger 30.

The function and operations of the bellows pump 1 is hereinafter described.

With the second communication port 33 opened as shown in FIG. 1, when the eccentric cam 36 rotates and the plunger 30 slightly moves down, the second communication port 33 is closed with the plunger contact member 26 formed as the annular member. When the plunger 30 further moves down, inner pressure of the second work chamber 20 increases and the bellows 10 contracts. Then the fluid 81 is pumped out from the first work chamber 11 (the check valve 131 is closed and the check valve 132 is opened).

Figure 2:
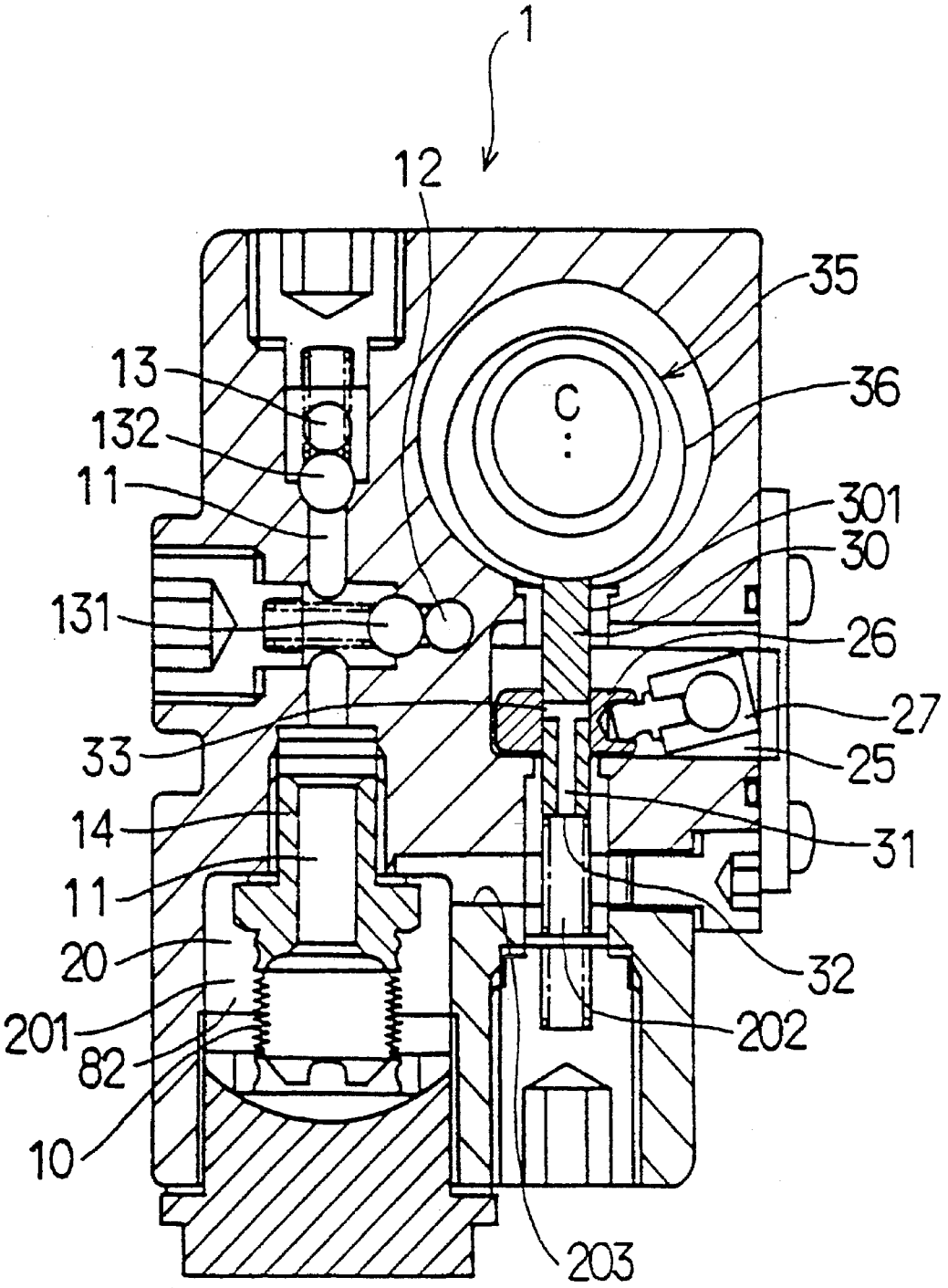
FIG. 2 is a longitudinal sectional view of the bellows pump according to Embodiment 1 (at a bottom dead center of the plunger)

As FIG. 2 shows, when the eccentric cam 36 rotates in a half way, the plunger 30 reaches a bottom dead center.

When the eccentric cam 36 further continues rotating, the plunger 30 begins to move up and the bellows 10 begins to expand. As a result, the fluid 81 is pumped into the first work chamber 11 (the check valve 131 is opened and the check valve 132 is closed). The plunger 30 reaches a top dead center and completes one cycle.

The outflow rate of the fluid 81 at the aforementioned single cycle varies with the location of the second communication port 33 relative to the plunger contact member 26. Operating the communication positioning means 27 to change the position of the second communication port 33 may vary the flow rate Q of the bellows pump 1.

Operating the communication positioning means 27 in accordance with the engine load enables the supplied fuel amount to vary with the engine load, thus eliminating unnecessary operation such as relieving excessive fuel.

in the event bubbles intrude into the second work chamber 20 of the bellows pump 1 of the present invention, they are forced to go up from the main room 201 toward the sub room 202 and further go up toward the work fluid chamber 25 through the flow channel 31.

The bubble, therefor&, no longer remains within the second work chamber 20, preventing the performance and efficiency of the pump from deteriorating.

EMBODIMENT 2

As shown in FIG. 3, a second work chamber 40 of a bellows pump 1 according to the present invention has a main room 41 for housing a bellows 10 and a sub room 42 for housing a plunger 30.

Disposed between the main room 41 and the sub room 42 are an upper passage 43 spanning from the main room 41 to the sub room 42 in substantially a horizontal direction for communicating the top part of the main room 41 with the sub room 42, and a lower passage 44 for communicating bottom part of the main room 41 below the bellows 10 with the bottom part of the sub room 42.

As shown in FIG. 4, disposed between the second work cheer 40 and a work fluid chamber 45 is a bypass 46 which is normally closed. The bypass 46 is provided with a check valve 47 which opens when the pressure of the second work chamber 40 becomes lower than that of the work fluid chamber 45. A reference numeral 271 denotes a shaft for driving the communication positioning means Referring to FIGS. 3 and 4, attached to the bellows 10 is a fixed member 15 which defines a male screw part 151 for being brazed to the first work chamber 11. The fixed member 15 has a hexagonal bore 152 formed therein, through which a hexagonal end of a rotating tool for brazing is fit.

In the bellows pump 1 of the present invention, an axial direction of the plunger 30 is inclined at a constant degree to that of the bellows 10. The bottom of the main room 41 communicates with that of the sub room 42 through the lower passage 44 formed in a cover member 51.

Accordingly in case the plunger 30 descends when the second communication port 33 is closed, the work fluid passes through both the upper and lower passages 43 and 44 to flow from the sub room 42 into the main room 41, thus pressing up the bellows 10. Operation of contraction and expansion of the bellows 10 caused by the pressure difference is likely to be relatively wider ranged. Namely, the response of the bellows operation becomes faster. Especially when operating the bellows 10 at higher speed, the pressure difference between inside and outside thereof becomes too large to keep the service life of the bellows 10 prolonged.

Formed on the top of the main room 41 is the upper passage 43 serving to force bubbles into the work fluid chamber 45 in the same manner as Embodiment 1. In FIG. 3, the sub room 42 is provided with a sleeve 52 for guiding the plunger 30 and a spring 53 for pressing the plunger 30 toward the drive member 36.

The bore 152 formed in the fixed member 15 has a hexagonal cross section through which a hexagonal wrench is inserted from the first work chamber 11. The end of the hexagonal wrench is fitted to the bore 152 to braze the fixed member to the housing. The above construction eliminates the clearance between outer periphery of the bellows 10 and an inner wall of the main room 41, resulting in decreasing unnecessary space in the second work chamber. Accordingly the exhaust flow rate of the bellows pump 1 is relatively increased.

Valve sheets 131A and 132A and springs 131B and 132B of the check valves 131 and 132, respectively are provided in the first work chamber 11. In FIG. 4, reference numerals 471 and 472 denote a valve sheet and a spring of the check valve 47, respectively.

FIG. 4 represents a cross section of the bellows pump when viewed with the break-out section of FIG. 3 moved in a direction of an axial center C of the eccentric cam Referring to FIG. 4, the bypass 46 is provided the between outer periphery of the bellows 10 in the main room 41 and a lower part of the work fluid chamber 45. When the pressure of the second work chamber decreases, the check valve 47 opens and the work fluid flows from the work fluid chamber 45 thereinto so as to offset the balance of the pressure between the second work chamber 40 and the work fluid chamber 45. This serves to prevent bubbles form flowing backward from the work fluid chamber 45 to the second work chamber 40.

When ascending plunger 30 lowers the pressure of the second work chamber 40, the pressure of the first work chamber 11 causes the bellows 10 to expand, by which the work fluid flows from the main room 41 to the sub room 42. At the same time, the second communication port 33 opens to communicate the work fluid chamber 45 with the second work chamber 40 through the flow channel 31. During the period when the plunger 30 ascends to open the second communication port 33, the pressure of the second work chamber 40 decreases to a negative pressure. However the negative pressure is immediately offset by opening the check valve 47. Other constructions and features are the same as those of Embodiment 1.

The present invention provided an excellent bellows pump exhibiting stable and highly efficient performance irrespective of intrusion of the bubble into the work fluid.

What is claimed is:

1. A bellows pump for pumping fluid by operating a bellows comprising:

a first work chamber for admitting said fluid, said first work chamber being communicable with an inlet port and an outlet port;

a second work chamber for storing work fluid;

a bellows being capable of expansion and contraction, and disposed between said first work chamber and said second work chamber;

a plunger being movable in a reciprocative manner to and from said second work chamber;

a work fluid chamber opened to store said work fluid; and a drive member for driving said plunger, said plunger being provided with a flow channel, one end of the flow channel having a first communication port that constantly communicates with said second work chamber, and the other end of said flow channel being provided with a second communication port which communicates with said work fluid chamber only when said plunger retracts at initial and completing stages of an inflow process of said fluid;

at least said second communication port communicating with said work fluid chamber, the first communication port being located in the vicinity of a top of said second work chamber, and said second communication port being located above said first communication port.

2. A bellows pump according to claim 1, wherein said second communication port is formed in an outer peripheral surface of said plunger, said work fluid chamber being in contact with said outer peripheral surface of said plunger, and including a plunger contact member for alternately closing and opening said second communication port during movement of said plunger; and a communication positioning means for changing a position of said second communication port relative to said work fluid chamber by moving said plunger contact member.

3. A bellows pump according to claim 2, wherein said plunger contact member is formed as an annular member engaged with the outer peripheral surface of said plunger, and said communication positioning means is formed as a drive member for moving said annular member in the axial direction of said plunger.

4. A bellows pump for pumping fluid by operating a bellows comprising:

a first work chamber for admiring said fluid, said first work chamber being communicable with an inlet port and an outlet port;

a second work chamber for storing work fluid;

a bellows being capable of expansion and contraction, and disposed between said first work chamber and said second work chamber;

a plunger being movable in a reciprocative manner to and from said second work chamber;

a work fluid chamber opened to store said work fluid; and a drive member for driving said plunger, said plunger being provided with a flow channel, one end of the flow channel having a first communication port that constantly communicates with said second work chamber, and the other end of said flow channel being provided with a second communication port which communicates with said work fluid chamber only when said plunger retracts at initial and completing stages of an inflow process of said fluid;

at least said second communication port communicating with said work fluid chamber, the first communication port being located in the vicinity of a top of said second work chamber, and said second communication port being located above said first communication port, said second work chamber containing a main room for housing said bellows and a sub room for housing said plunger, between said main room and sub room there are an upper passage formed in substantially a horizontal direction spanning from said main room toward said sub room for communicating a top part of said main room with said sub room, and a lower passage for a communicating bottom part of said main room below said bellows with said sub room.

5. A bellows pump according to claim 1, wherein a bypass is provided between said second work chamber and said work fluid chamber, said bypass being normally closed and provided with a check valve which opens when the pressure of said second work chamber becomes lower than that of said work fluid chamber.

6. A bellows pump according to claim 1, wherein said bellows is attached to a fixed member having a male screw part.

* * * * *